United States Patent [19]

Birchenough

[11] 4,033,316

[45] July 5, 1977

[54] SUSTAINED ARC IGNITION SYSTEM

[75] Inventor: Arthur G. Birchenough, Brook Park, Ohio

[73] Assignee: The United States of America as represented by the Administrator of the National Aeronautics and Space Administration, Washington, D.C.

[22] Filed: June 3, 1975

[21] Appl. No.: 583,485

[52] U.S. Cl. ..... 123/148 E; 123/148 CB; 315/176

[51] Int. Cl.[2] ..... F02P 1/00

[58] Field of Search ... 123/148 E, 148 CB, 148 CA; 315/176, 170, 337

[56] References Cited

UNITED STATES PATENTS

| | | | |
|---|---|---|---|
| 2,784,349 | 3/1957 | Anderson | 315/176 |
| 2,975,331 | 3/1961 | Diaz | 315/176 |
| 3,334,270 | 8/1967 | Nuckolls | 315/176 |
| 3,788,293 | 1/1974 | Anderson | 123/148 E |
| 3,919,993 | 11/1975 | Neuman | 123/148 E |

*Primary Examiner*—Ronald B. Cox
*Attorney, Agent, or Firm*—N. T. Musial; J. A. Mackin; John R. Manning

[57] ABSTRACT

Circuitry for maintaining an arc or spark across a spark gap for a desired length of time is disclosed. A high-voltage, direct-current (dc) source is connected in series with a secondary winding of a high voltage, step-up transformer or coil and a spark gap such as a spark plug for example. The high-voltage source may be on continuously or may be turned on and off by a control circuit such as a solid state switch which is, in turn, responsive to a timing device such as a set of ignition contact points or a magnetic pulse generator operating in synchronism with a spark ignition engine. The timing device also provides signals to a current switching circuit which interrupts current flow through a primary winding of the high-voltage coil at the prescribed time that a spark is desired at the spark gap.

The control circuit may, if desired, include both a switch and a multivibrator if the timer is of the pulse-generating magnetic type.

17 Claims, 7 Drawing Figures

SUSTAINED ARC IGNITION SYSTEM

ORIGIN OF THE INVENTION

The invention described herein was made by an employee of the United States Government and may be manufactured or used by or for the Government of the United States without the payment of any royalties thereon or therefore.

BACKGROUND OF THE INVENTION

In recent years many efforts have been made to reduce or eliminate certain pollutants which are emitted in the exhaust gas of vehicles utilizing various types of internal combustion engines. These pollutants include carbon monoxide, various hydrocarbons and nitrous oxides.

Unfortunately, modifications to spark ignition engines generally cause the oxides of nitrogen to increase when the carbon monoxide and hydrocarbons are reduced and vice-versa. At the present time, it appears that the hydrocarbons and carbon monoxide can be controlled by devices such as catalytic converters or by providing precombustion chambers in which a rich mixture is ignited by spark ignition, the flame from the precombustion chamber then igniting a lean mixture in the main combustion chamber.

One way to reduce nitrous oxide emissions of a spark ignition engine is to operate at an extremely lean fuel-to-air ratio. Such lean operation will both increase engine efficiency and reduce pollutants. However, lean mixtures are difficult to ignite and as the mixture is made leaner and leaner the number of misfires increases causing increased amounts of carbon monoxide and hydrocarbon in the exhaust.

Satisfactory ignition is even more of a problem with rotaty type engines and stratified charge engines. Dual spark plugs and dual ignition systems are employed in some Wankel (rotary) engines to obtain the necessary burning pattern. The fuel charge in a stratified engine is difficult to ignite satisfactorily with a single spark or multiple short duration sparks.

In order to provide lean operation of a spark ignition engine without requiring the great complexity and expense entailed by using precombustion chambers, ignition systems have been developed to provide hotter and higher quality arcs across the spark gaps of spark ignition engines. One of these ignition systems is the well-known capacitive-discharge type wherein a voltage pulse having a sharp wave front and a magnitude several times that of conventional ignition systems is applied to the spark gap. The type of spark provided by the C-D type ignition system is extremely short and, while it may fire fouled spark plugs and minimize high voltage losses through leakage in cables and semiconductive deposits on the spark gaps, it does not provide maximum ignition of the lean fuel air mixture.

Some other types of ignition systems which provide multiple, repetitive sparking across the spark gaps have been developed to provide a higher probability of ignition of a lean fuel air mixture. It has been found that neither the C-D ignition system nor the multiple sparking ignition system is as effective in firing a lean fuel-air mixture in a spark ignition engine as a spark of extended duration.

OBJECTS AND SUMMARY OF THE INVENTION

It is an object of the invention to provide for a spark-ignition engine, ignition circuitry which will fire or ignite a leaner mixture than could prior arc ignition systems and which will produce superior ignition for rotary engines and stratified charge engines.

It is a further object of the invention to provide for a spark-ignition engine, circuitry which provides an arc or spark of any desired duration across the spark gap or gaps of such an engine.

It is another object of the invention to provide circuitry of the foregoing type which may be added to conventional ignition circuits relatively easily.

Still another object of the invention is to provide circuitry which will approximately double the duration of the ignition spark when the engine is running at about one half its maximum allowable rpm.

Yet another object of the invention is to provide an ignition system when the ignition spark is maintained by a high voltage of only several thousand volts thereby reducing stress on cable insulation and reducing the high voltage requirements of the source itself.

In summary, the invention provides circuitry for adding high voltage to the high voltage secondary of a spark-ignition system high voltage coil at prescribed times to sustain the arc across a spark gap for a desired period of time. Timing signal generating devices and control circuits are used to add the high voltage at the correct time.

DESCRIPTION OF THE PREFERRED EMBODIMENT

Figure 1:
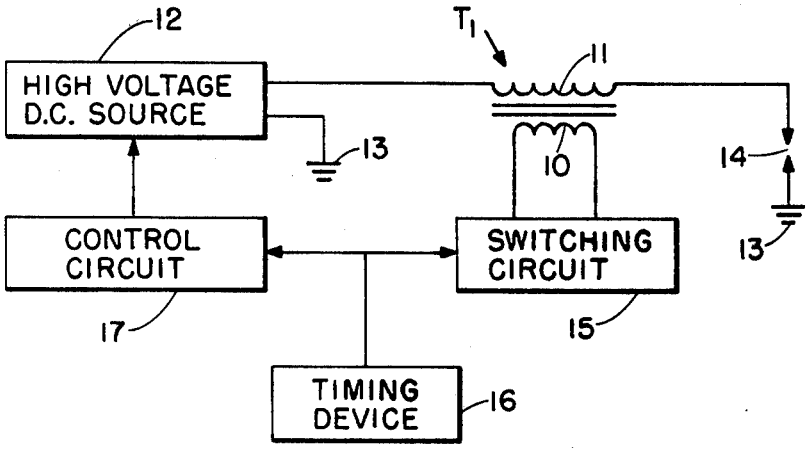
FIG. 1 is a block diagram of spark ignition circuitry embodying the invention.

Referring now to FIG. 1, there is shown an ignition circuit embodying the invention and comprised of an ignition coil T1 having a low voltage primary winding 10 and a high voltage secondary winding 11. As shown, one end of the secondary winding 11 is connected to a high voltage dc source 12 which is grounded as at 13. The other end of the secondary winding 11 is also connected to the ground 13 via a spark gap 14. As is well known, for a multiple cylinder engine a distributor may be interposed between the secondary winding 11 and a plurality of spark gaps such as 14 to direct voltage to each spark gap at the correct time. Because the grounds 13 are common, that is they are electrically the same point, the high voltage dc source 12 is in effect connected in series relationship to the secondary winding 11 and the spark gap 14.

To produce a spark or arc across the spark gap 14 to ignite a fuel-air mixture at predetermined times during the operation of a spark-ignition engine, current flowing through the primary winding 10 from a suitable switching circuit 15 must be interrupted. This interruption causes a magnetic field produced by primary winding 10 to collapse, thereby inducing a high voltage on the order of 10 kV to 40 kV or more in the secondary winding 11. In order to cause the desired interruption of current in the primary winding 10 of ignition coil T1, a timing signal generating device 16 is provided and operates in synchronism with the engine for which the ignition spark is to be provided. The timing device also produces a signal for a control circuit 17 so that the high voltage dc source is turned on to produce a high voltage output which is added to the high voltage induced in secondary winding 11 upon interruption of current in primary winding 10.

For the spark gap opening generally used in spark ignition engines, the voltage induced on secondary winding 11 of the ignition coil T1 must be on the order of 10 kV to 40 kV or more to produce an arc across the spark gap. However, once the arc has been established, a much lower voltage will sustain it. Consequently, in the circuitry of FIG. 1, it has been found that the high voltage dc source need only have a magnitude in the range of from about 1 kV to 4 kV. With this arrangement, the arc across the spark gap will be maintained as long as the high voltage dc source is providing its high voltage output.

Figure 2:
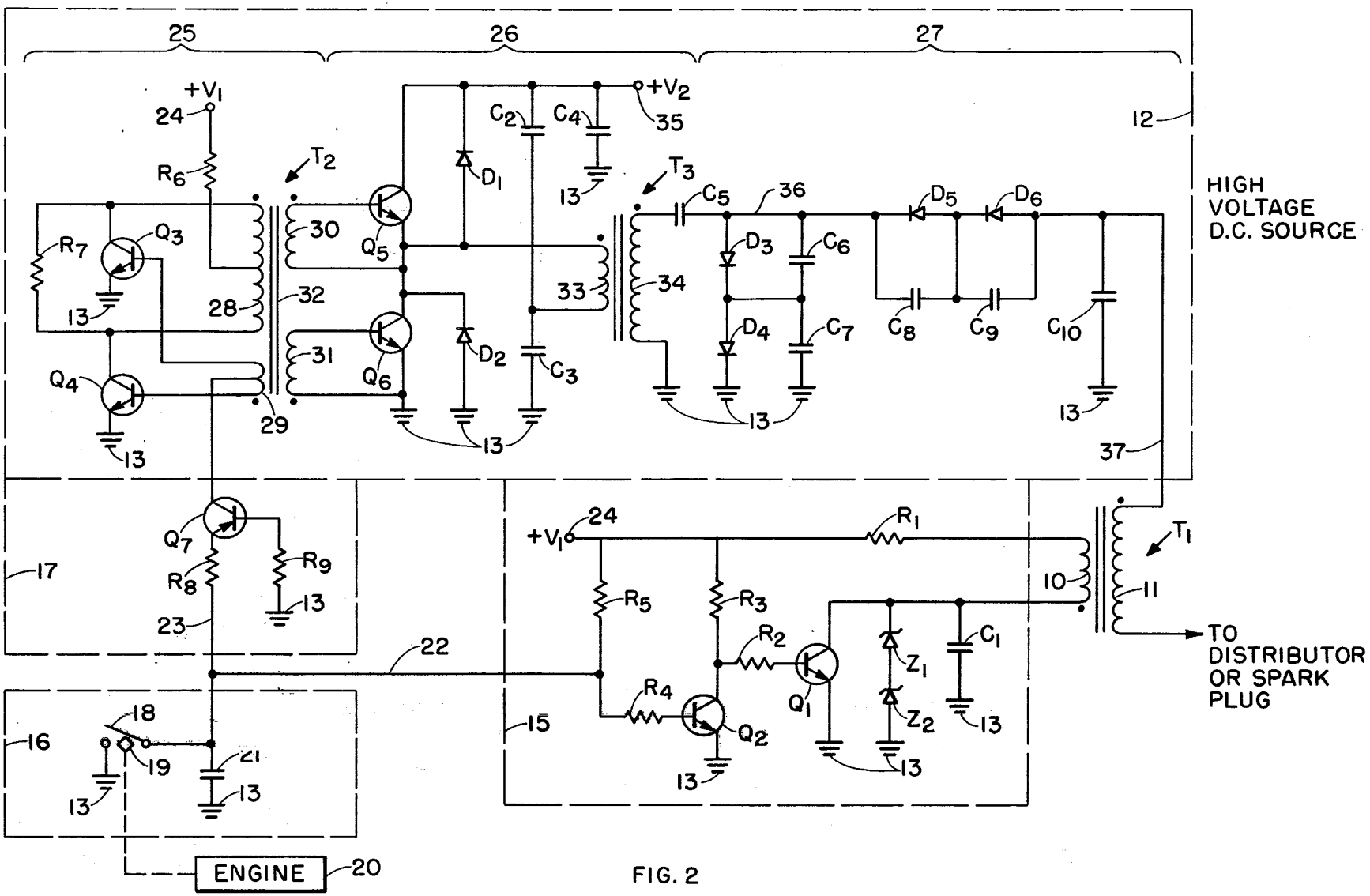
FIG. 2 is a schematic diagram showing the components used in each of the blocks of the diagram of FIG. 1.

Referring now to FIG. 2, there is shown a schematic diagram of the components in circuitry utilized in the circuit of FIG. 1 and portions equivalent to the blocks of FIG. 1 are identified by corresponding numerals. Timing device 16 is comprised of a set of ignition contact points 18 which are opened by a cam 19 each time a spark is desired at the spark gap or gaps. The cam rotates in synchronism with spark ignition engine 20. The usual capacitor 21 may be connected across the contact points 18 allowing easy conversion back to the original system. The contact points 18 are connected via a lead 22 to switching circuit 15 which will now be described.

As shown, switching circuit 15 provides for the connection of one end of primary winding 10 of the ignition coil T1 to a positive voltage V1 as at 24 through a suitable ballast resistor R1 while the other end of primary winding 10 is connected via the collector-emitter circuit of an NPN transistor Q1 to ground as at 13. Zener diodes Z1 and Z2 serially connected between the collector electrode of Q1 and ground and capacitor C1 connected between the same points protect the transistor Q1 from destructive voltages which might occur when the current through primary winding 10 is switched off.

To control the conduction of transistor Q1, its base electrode is connected through a resistor R2 to a point between a resistor R3 and an NPN transistor Q2, the resistor R3 and the collector-emitter half of transistor Q2 being connected serially between the positive dc potential at 24 and ground. The base electrode of transistor Q2 is connected through resistors R4 and R5 to a potential V1 at 24. The lead 22 from the contact set 18 is connected to a point between the resistors R4 and R5. As will be explained presently, when the contact points open, transistor Q2 is rendered conducting to turn off transistor Q1, thereby producing a high voltage on the secondary winding 11 of ignition coil T1.

The high voltage dc source 12 comprises an oscillator section 25, a power section 26 and a rectifying section 27. Oscillatory section 25 includes a transformer T2 having a center tapped primary winding 28, a center-tapped feedback winding 29 and a pair of drive windings 30 and 31 carried on a saturable core 32. As viewed in the drawing, the upper end of winding 28 is connected through the collector-emitter path of a transistor Q3 to ground while the lower end of the winding is connected through the collector-emitter path of an NPN transistor to ground. The base electrodes of transistors Q3 and Q4 are connected to respective ends of feedback winding 29. Current for transistors Q3 and Q4 is obtained by connecting the center tap of winding 28 through a resistor R6 to the positive potential V1 as at 24. A resistor R7 may be connected across winding 28 to eliminate parasitic oscillations.

Power section 26 of the high voltage source 12 includes a high voltage step-up transformer T3 having a low-voltage primary winding 33 and a high voltage secondary winding 34 and NPN type transistors Q5 and Q6. The collector-emitter paths of transistors Q5 and Q6 are serially connected between a positive potential V2 as at 35 and common ground as at 13. The base-emitter paths of transistors Q5 and Q6 are connected to drive windings 30 and 31 of transformer T2 in the oscillator section as shown.

To the end that a square wave voltage will be generated on primary winding 33, the upper end thereof is connected to a point between the emitter electrode of Q5 and the collector electrode of Q6 while the lower end, as shown, is connected to a point between a pair of capacitors C2 and C3 which are serially connected between a positive potential V2 as at 35 and ground 13. Diodes D1 and D2 are connected across the collector-emitter paths of transistors Q5 and Q6 to protect the transistors from possibly destructive voltages. Likewise, the capacitor C4 is connected between the positive potential as at 35 and ground 13 to suppress any voltage spikes which might be present on the positive voltage V2 at the point 35.

The secondary winding 34 of transformer T3 has its upper end connected to a dc blocking capacitor C5 of rectifying section 27 while its lower end is connected to ground as at 13. The high voltage square wave signal is produced on the secondary winding 34 of transformer T3 because of the switching action of transistors Q5 and Q6 as controlled by oscillator 25. This high voltage is coupled through capacitor Q5 to the rectifier section 27.

In the rectifier section, rectifiers D3 and D4 are serially connected between a lead 36 and ground 13, the lead 36 being connected to capacitor C5 of the power section, and also to a high voltage output lead 37 through rectifiers D5 and D6. Capacitors C6, C7, C8 and C9 bridge the rectifiers D3, D4, D5 and D6, respectively, to absorb destructive voltage spikes. To filter the high voltage pulses which would normally appear on the lead 37 due to the rectifying action of rectifiers D3 through D6, a filter capacitor 10 is connected between lead 37 and ground 13.

The arrangement of rectifiers D3, D4, D5 and D6, as shown with capacitors C10 and C5, form a voltage doubling circuit. The use of the voltage doubling circuit advantageously permits a reduction in the size of secondary winding 34 of transformer T3. It will be understood that rectifying circuits giving other voltage multiples can be used but consideration must be given to size and weight of capacitors needed as balanced against the advantages of reducing the size of transformer T3. For example, a well known Cockroft-Walton voltage multiplier circuit could be used but requires a great number of rectifiers and capacitors.

To the end that the oscillator 25 of high voltage section 12 will begin to oscillate when the contact points 18 of timing section 16 open, there is provided a control circuit 17. The control circuit 17 is comprised of a switch or gate such as a PNP type transistor Q7. The collector electrode of Q7 is connected to the center tap of feedback winding 29 of transformer T2 in the oscillator section 25 while the emitter electrode is connected through a resistor R8 and lead 23 to the contact points 18. The base electrode of transistor Q7 is connected through a resistor R9 to ground 13. As will be explained presently, transistor Q7 is rendered conducting when the contact points 18 of timing section 16 open, thus allowing feedback current to be provided to the base electrodes of transistors Q3 and Q4 of the oscillator section 25. When the oscillator section 25 begins to generate oscillating current, a high voltage will be produced at the high voltage output lead 37.

Operation of the circuitry of FIG. 2 will now be explained in conjunction with the waveshapes of FIG. 3. Assuming initially that the contact points 18 are closed, the lower end of resistor R5 of section 15 is grounded. Thus, the base electrode of transistor Q2 of section 15 and the emitter electrode of transistor Q7 of section 17 are at ground potential and neither of those transistors will conduct. Because transistor Q2 is nonconducting, a positive potential is applied to the base electrode of transistor Q1 causing it to be fully conducting. Consequently, current flows from potential V1 at 24 through resistor R1, primary winding 10 of ignition coil T1 and the collector-emitter path of transistor Q1 to ground 13. This condition is represented by the base lines 38, 39 and 40 for the points, arc voltage and arc current, respectively. At some point in time T1 the contact points open, thereby causing current to flow through the base-emitter circuit of transistor Q2 and through the emitter-base circuit of transistor Q7, rendering those transistors conducting. When transistor Q2 turns on, the base electrode of transistor Q1 is at near ground potential and transistor Q1 turns off. This causes the magnetic field produced by the current in the primary winding 10 of ignition coil T1 to collapse inducing a high voltage in the secondary winding 11. This high voltage causes an arc or spark to occur across the spark gap to which the secondary winding 11 is connected.

Figure 3:
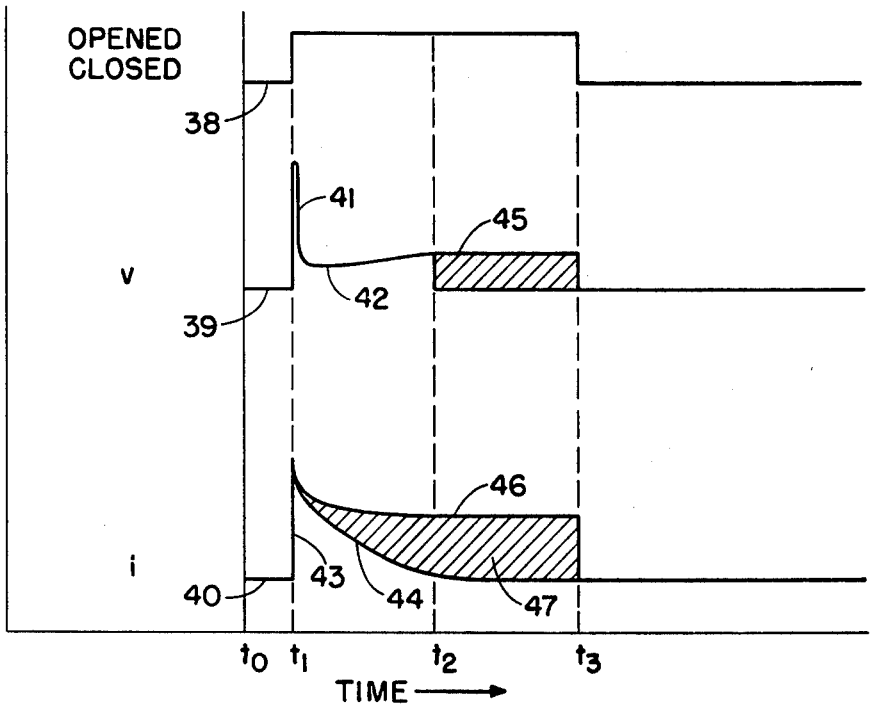
FIG. 3 is a graph of the wave shapes which are generated by the ignition circuitry embodying the invention.

The initial voltage spike which is produced at the spark gap to cause breakdown is shown at 41 in FIG. 3. After the arc is established the voltage drops to a level as at 42 and normally continues until the time T2. The peak to which the arc current rises is indicated as at 43 and the normal decay of the current to 0 at the base line 40 is indicated as at 44.

When the transistor Q7 goes from a nonconducting to a fully conducting state simultaneously with transistor Q2, feedback voltage is applied to the base electrodes of transistors Q3 and Q4. One or the other of transistors Q3 and Q4 will begin conducting until the core 32 of transformer T2 saturates, causing the operation to reverse whereupon the other transistor will conduct. This produces square wave voltages on drive windings 30 and 31. The frequency of oscillation of oscillator section 25 is on the order of 10 kilohertz.

Transistors Q5 and Q6, of course, because of the square wave voltage impressed on drive windings 30 and 31, alternately switch on and off producing a square wave voltage on primary winding 33 and secondary winding 34 of transformer T3. Thus, there is delivered to capacitor C5 a high-frequency, alternating, square-wave voltage.

The alternating, high-frequency square-wave voltage is rectified and doubled by the diodes D3, D4, D5 and D6 with capacitors C5 and C10 and produces a high voltage output on lead 37 which is connected to one end of the secondary winding 11 of ignition coil T1.

Because of the high voltage output of high voltage section 12, the arc across the spark gap will be maintained as shown at 45 in FIG. 3 until the oscillator is deactivated as at time T3. Thus, the voltage across the arc will be maintained until the contact points 18 again close. As shown in FIG. 3, the duration of the arc across the spark gap is extended from time $t_2$ to time $t_3$, thus making the duration of the arc two to four times greater than conventional arcs where the spark ignition engine is running at a speed somewhere in the range of from about 40 to 60 percent of its maximum rpm.

Because of the current source characteristic of the high-voltage dc source 12, current remains essentially constant, as shown at 46 in FIG. 3, from the time it begins flowing across the spark gap except for an initial drop. The decay of spark current in a conventional ignition system is illustrated at 44. The shaded area 47 represents the increased power in the arc and is roughly four to ten times as great as the normal arc power of conventional ignition systems.

While the circuit of FIG. 2 has been described with respect to a high voltage dc source comprised of a saturable core oscillator 25, a power section 26, and a rectifying circuit 27, other suitable circuits for generating high voltage dc may be utilized. An example is the so-called high-voltage flyback circuit much like that in the high-voltage flyback circuit of a television set, but operating at a substantially lower voltage. A rectifying circuit which may be connected as a voltage doubler, tripler or other multiplier converts the repetitive voltage pulses to direct current as in the embodiment shown in FIG. 2.

As the load (the arc) on the high-voltage source is essentially a constant voltage, the inverter should have a constant current or current limiting feature. This feature is provided inherently in flyback inverter designs and is created in the inverter of FIG. 2 by the impedance of the transformer rectifier configuration.

ALTERNATE EMBODIMENTS

Figure 4:
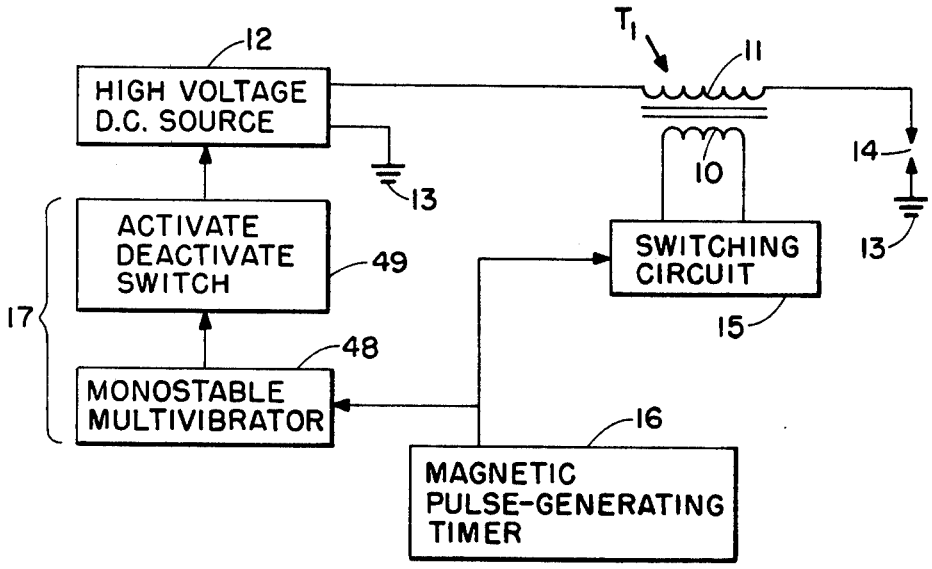
FIG. 4 is a block diagram of circuitry wherein the timing device and the control circuit are slightly modified with respect to FIG. 1.

Referring now to FIG. 4, there is shown an ignition circuit similar to that of FIG. 1 and components corresponding to components of FIG. 1 are identified by the same numerals used in FIG. 1. In the circuit of FIG. 4, the timing device 16 comprises a magnetic toothed wheel rotating in synchronism with the spark ignition engine and a pickup coil which sends a voltage pulse to the switching circuit 15 to produce an arc across spark gap 14. Because this voltage pulse may be of insufficient duration to be utilized to activate the high voltage source 12 for as long a period of time as desired, monostable multivibrator 48 is used to control and activate-deactivate switch 49 which corresponds to transistor Q7 shown in FIG. 2. Multivibrator 48 is triggered by the same voltage pulse fed to switching circuit 15.

A monostable multivibrator is one which has a normal state in which one transistor is conducting and the other is turned off. An input pulse will cause the transistors to reverse conditions for a brief period of time after which they will revert to their normal state. With the particular arrangement shown in FIG. 4, multivibrator 48 is connected to provide an output to activate-deactivate switch 49 for a prescribed period of time after receiving an input pulse from the timing section 16. It will be understood by those skilled in the art that the duration of the ouput signal of multivibrator 48 is determined by various time constants and components of multivibrator 48 and which may be selected or designed to provide the appropriate output signal duration.

Although the circuit of FIG. 4 utilizes a monostable multivibrator 48 between the timer 16 and the switch 49, the multivibrator is not an essential part of the circuit. The voltage pulses provided by most magnet pulse-generating timers are of sufficient duration that, when directed to the switch 49, they will cause the high voltage d-c source to be turned on for an adequate portion of the operating cycle to substantially increase the spark duration over that of conventional circuits.

Figure 5:
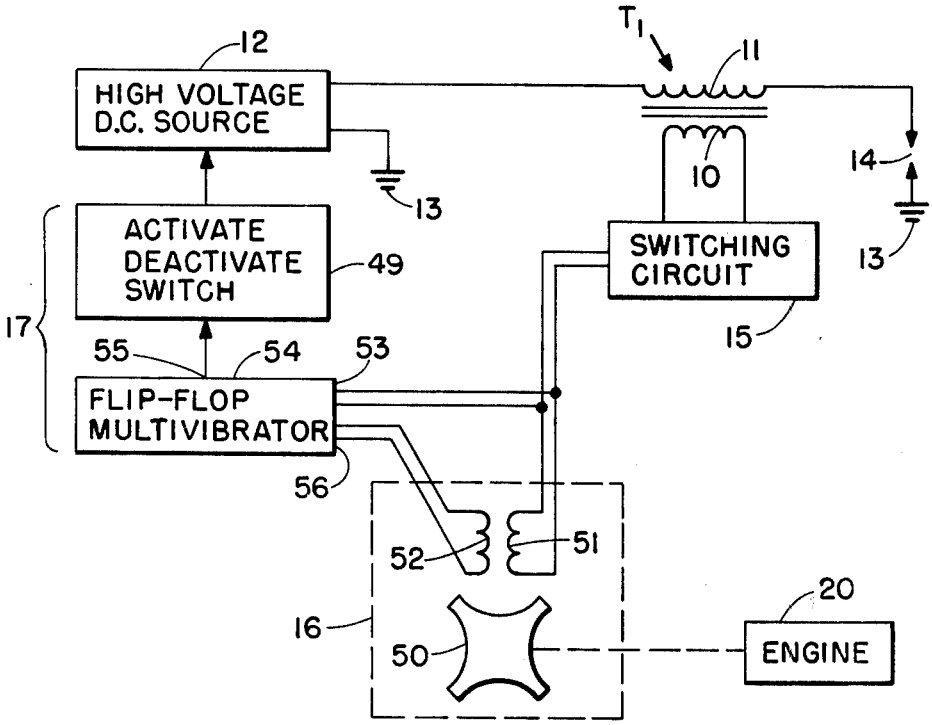
FIG. 5 is another block diagram of a slight modification to the circuitry of FIG. 1.

FIG. 5 shows another ignition circuit which is similar to those of FIGS. 1 and 4 and components corresponding to those of FIGS. 1 and 4 are identified by corresponding numerals. A magnetic, toothed wheel 50 rotates in synchronism with a spark ignition engine 20 and produces a voltage pulse first in a pickup coil 51 and a short time later in a pickup coil 52 as each tooth of the wheel 50 passes the coils. The earlier pulse appearing on pickup coil 51 is directed to the switching circuit 15 and causes an arc to jump the spark gap 14. This same voltage pulse is directed to a first input 53 of a flip-flop multivibrator 54 causing it to direct a turn-on signal from an output 55 to activate-deactivate the switch 49. When the switch 49 is turned on, the high voltage dc source 12 will produce an ouput voltage which is added to that on the secondary winding 11 of T1. The high voltage dc source 12 will continue to produce an output voltage to maintain the arc across spark gap 14 as long as the flip-flop multivibrator 54 has an output. Thus, as wheel 50 rotates, it provides first and second voltage pulses at predetermined times during each cycle of operation of the engine.

The voltage pulse produced on pickup coil 52 following the one produced on coil 51 is directed to a second input or reset input 56 of the flip-flop multivibrator 54 causing it to revert to its original state wherein no output signal is supplied from its output 55 to the activate-deactivate switch 49. Thus, it will be seen that in the circuit of FIG. 5, a first turn-on pulse causes the flip-flop multivibrator 54 to produce an output and at the same time causes switching circuit 15 to interrupt current flow through the primary winding 10 of ignition coil T1 to cause a spark at spark gap 14. A second or turn-off pulse from pickup coil 52 resets the flip-flop multivibrator 54 to terminate its output, in turn terminating the high voltage output of the high voltage dc source 12 to extinguish the arc across the spark gap 14.

Figure 6:
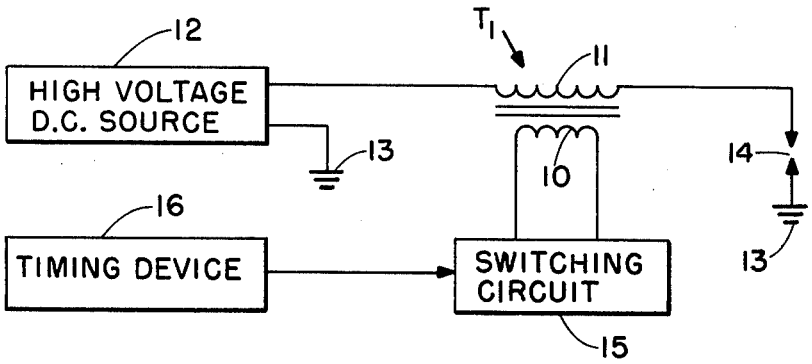
FIG. 6 is a block diagram of the most basic form of the invention.

FIG. 6 is a block diagram of the most basic form of the invention and parts corresponding to those in the other figures are identified by corresponding numerals. In the ignition system of FIG. 6, the timing device 16 will cause switching circuit 15 to interrupt current flow through primary winding 10 of ignition coil T1 at a predetermined point in the operation of a spark ignition engine with which the system is used. This produces a spark across the spark gap 14.

As soon as a spark jumps the gap 14, the high voltage source which is continuously on provides sufficient high voltage to prevent the spark from being extinguished for a relatively long period of time. However, sometimes before the next spark is required, the normal operational cycle such as exhaust, intake or compression will cause the spark to be extinguished.

Figure 7:
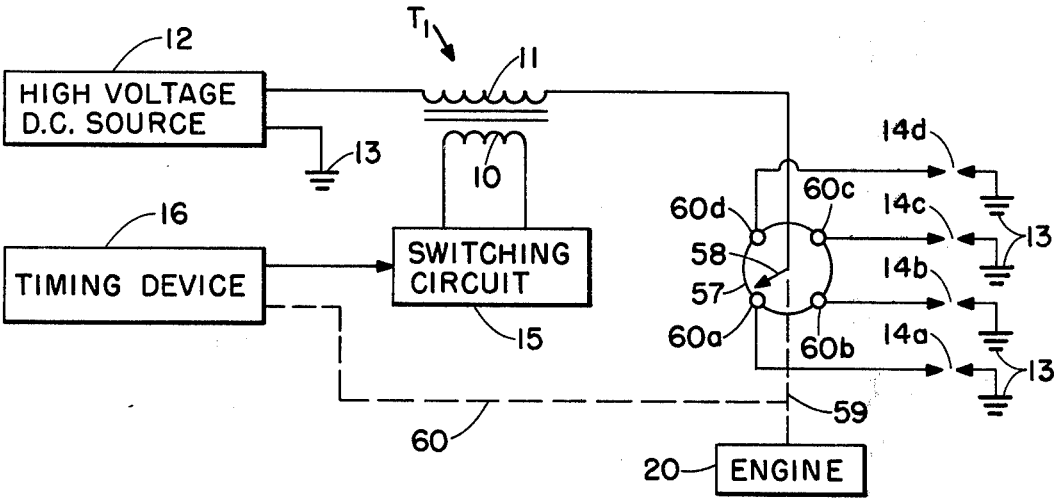
FIG. 7 is a block diagram of a modification of the circuit of FIG. 6.

FIG. 7 illustrates a system similar to that shown in FIG. 6 except for a distributor 57 which is added with a plurality of spark plugs 14*a*, 14*b*, 14*c* and 14*d*. One end of the coil secondary winding 11 is connected to the high voltage dc source 12 while the other end is connected to a rotor 58 of distributor 57. The rotor rotates in synchronism with engine 20, as indicated by dash line 59 and dependence of the timing device 16 on the rotation of engine 20 is represented by dashed line 60.

As rotor 58 moves from a contact 60*a* to 60*b* it breaks the current path from the high voltage source 12 and winding 11 to extinguish the spark across gap 14*a*. In a like manner the sparks across 14*b*, 14*c* and 14*d* are extinguished as the rotor 58 moves away from contacts 60*b*, 60*c* and 60*d*, respectively. Thus, in the system of FIG. 7, the sparks are controlled in duration by the distributor 57 interposed between the secondary winding 11 and the plurality of spark gaps 14*a*, 14*b*, 14*c* and 14*d* even though high voltage source 12 provides a continuous output voltage.

It will be understood that changes and modifications may be made to the foregoing described ignition circuits by those skilled in the art without departing from the spirit and scope of the invention as set forth in the claims appended hereto. For example, the timing device 16 may be of the photoelectric type rather than the contact point or magnetic pulse generating types discussed.

What is claimed is:

1. An internal combustion engine ignition system comprising:

a step-up voltage coil having a primary winding and a secondary winding, said secondary winding having a first end and a second end, said second end being connected to common ground through a spark gap and which system produces a spark across the spark gap when current through the primary winding is periodically interrupted at controlled times;

means for supplying periodically interrupted current to said primary winding;

a high voltage d-c source connected between said first end of said secondary coil and ground; and means for activating said high voltage source when current through the primary is switched off but before said spark across the spark gap terminates and for deactivating said high voltage d-c source substantially later than the normal extinguish time of the spark.

2. The ignition system of claim 1 wherein said means for activating and deactivating said high voltage d-c source comprises control means connected to said high voltage source and timing means for providing a timing signal to said control means at rotational-related times during operation of the engine.

3. The ignition system of claim 2 wherein said timing means is a set of contact points which open and close in timed relationship to rotation of said engine.

4. The ignition system of claim 2 wherein said timing means is a photoelectric type switch operating in synchronism with said engine.

5. The ignition system of claim 2 wherein said timing means is a magnetic pulse generating means.

6. The ignition system of claim 5 wherein said control means includes gate means and a monostable multivibrator having at least one input and one output, said input being connected to said magnetic pulse generating means, said output being connected to said gate means which is connected in controlling relationship to said high voltage d-c source.

7. The ignition system of claim 2 wherein said timing means is magnetic pulse generating means which provides first and second voltage pulses at predetermined times during each cycle of operation of the engine, said control means being comprised of gate means and a flip-flop multivibrator having first and second inputs and an output, said first input being connected to receive each of said first voltage pulses, said second input being connected to receive each of said second voltage pulses, said output being connected to said gate means which is connected in controlling relationship to said high voltage d-c source.

8. The ignition system of claim 1 wherein said high voltage d-c source comprises a flyback type high voltage a-c source and a rectifier.

9. The ignition system of claim 8 and including control means for deactivating and activating said flyback type high voltage a-c source and timing means for providing a timing signal to said control means at predetermined times during the operation of said engine.

10. The ignition system of claim 9 wherein said timing means is a set of contact points which open and close in timed-relationship to the rotation of said engine, said contact points being connected between said common ground and said control means.

11. The ignition system of claim 9 wherein said timing means is a magnetic pulse generating means connected in controlling relationship to said control means.

12. The ignition system of claim 9 wherein said timing means is a magnetic pulse generating means which periodically provides a first voltage pulse followed by a second voltage pulse, said control means being comprised of gate means and a flip-flop multivibrator having first and second inputs and an output, said first input being connected to receive each of said first pulses, said second input being connected to receive each of said second pulses, said output being connected to said gate means which is connected in controlling relationship to said high voltage d-c source.

13. The ignition system of claim 1 wherein said high voltage d-c source comprises an oscillator having a feedback circuit and a rectifier, said system further including gate means connected in said feedback circuit, and timing means for opening said gate means to establish a feedback signal in said feedback circuit at predetermined times during the operation of said engine.

14. The ignition system of claim 13 wherein said timing means is a set of contact points which open and close in time relationship to the rotation of said engine, said contact points being connected between said common ground and a control terminal on said gate means.

15. The ignition system of claim 13 wherein said timing means is a magentic pulse generating means.

16. The ignition system of claim 15 and including a monostable multivibrator having at least one input and one output, said input being connected to said magnetic pulse generating means, said output being connected to a control terminal on said gate means.

19

17. The system of claim 1 and including distributor means connected between said second end and said secondary winding of said ignition coil and a plurality of spark gaps to make and break paths for current between said secondary winding and respective ones of said spark gaps in a predetermined engine rotational-related sequence.

* * * * *